US008172559B2

(12) United States Patent
Shimaguchi et al.

(10) Patent No.: US 8,172,559 B2
(45) Date of Patent: May 8, 2012

(54) HORIZONTAL TYPE ELECTRIC COMPRESSOR

(75) Inventors: Hirotada Shimaguchi, Kuki (JP); Masaki Watanabe, Oyama (JP); Jyunya Sugamuta, Saitama (JP)

(73) Assignee: Calsonic Kansei Corporation, Saitama-shi (JP)

( * ) Notice: Subject to any disclaimer, the term of this patent is extended or adjusted under 35 U.S.C. 154(b) by 573 days.

(21) Appl. No.: 12/342,850

(22) Filed: Dec. 23, 2008

(65) Prior Publication Data

US 2009/0162233 A1 Jun. 25, 2009

(30) Foreign Application Priority Data

Dec. 25, 2007 (JP) ..... 2007-332641
Jan. 16, 2008 (JP) ..... 2008-007264
Nov. 10, 2008 (JP) ..... 2008-288178
Nov. 10, 2008 (JP) ..... 2008-288181

(51) Int. Cl.
*F01C 1/02* (2006.01)
*F03C 2/00* (2006.01)

(52) U.S. Cl. ..... 418/55.1; 418/55.6; 417/366; 417/369

(58) Field of Classification Search ..... 418/55.1–55.6, 418/183, 186, 270, DIG. 1; 417/366, 902, 417/369
See application file for complete search history.

(56) References Cited

U.S. PATENT DOCUMENTS

| | | | | |
|---|---|---|---|---|
| 3,225,698 | A * | 12/1965 | Spisiak | 417/369 |
| 4,160,629 | A * | 7/1979 | Hidden et al. | 417/366 |
| 5,304,047 | A * | 4/1994 | Shibamoto | 418/55.2 |
| 5,788,470 | A * | 8/1998 | Okuda et al. | 418/55.4 |
| 6,158,995 | A * | 12/2000 | Muramatsu et al. | 418/181 |
| 6,565,329 | B2 * | 5/2003 | Yokomachi et al. | 417/366 |
| 6,568,928 | B2 * | 5/2003 | Gennami et al. | 418/55.4 |
| 2004/0146411 | A1 * | 7/2004 | Maceyka et al. | 417/369 |

FOREIGN PATENT DOCUMENTS

| | | | |
|---|---|---|---|
| JP | 60-119397 | A | 6/1985 |
| JP | 02-294591 | A | 12/1990 |
| JP | 05-312162 | A | 11/1993 |
| JP | 2005-344657 | A | 12/2005 |

* cited by examiner

*Primary Examiner* — Theresa Trieu
(74) *Attorney, Agent, or Firm* — Foley & Lardner LLP

(57) ABSTRACT

An electric compressor (201) includes: a compressor (203) configured to compress a refrigerant, the compressor (203) having a plurality of passage ports (207) delivering the refrigerant; an electric motor (205) configured to drive the compressor (203), the electric motor (205) having a plurality of stators (17) and an accommodation chamber (213) accommodating the plurality of stators (17); a partition wall (215) separating the compressor (203) and the an accommodation chamber (213) of the electric motor (205); and a plurality of refrigerant introducing/discharging passages (219) formed at the partition wall (215) wherein the respective refrigerant introducing/discharging passages (219) are located in a circumferential direction of the accommodation chamber (213), thereby the refrigerant being introduced into and discharged from stators (17) end in the electric motor (205) through the respective refrigerant introducing/discharging passages (219).

9 Claims, 11 Drawing Sheets

HORIZONTAL TYPE ELECTRIC COMPRESSOR

BACKGROUND OF THE INVENTION

1. Field of the invention

The present invention relates to an electric compressor.

2. Description of the Related Art

Technologies concerning an electric compressor as an electric gas compressor have been disclosed in Japanese Patent Application Laid-Open No. 2005-344657 (Patent Document 1).

This electric gas compressor (electric compressor) is used for a cooling system for a vehicle air conditioning system, and includes a compressor configured to compress a refrigerant, and an electric motor configured to drive the compressor. In general, electric compressors are each designed to cool the stators of the electric motor by causing a refrigerant compressed by and delivered from the compressor to flow to the stators.

The electric compressor in the related art includes a partition wall separating an accommodation chamber accommodating the electric motor and another accommodation chamber accommodating the compressor. The partition wall is formed with one refrigerant introducing passage which is constructed so as to connect the accommodation chamber accommodating the electric motor and the other accommodation chamber accommodating the compressor. The partition wall is formed at a lower portion of the partition wall.

In this connection, after the refrigerant passes by the stators and cools the stators of the electric motor, the refrigerant passes through the one refrigerant introducing passage formed at the lower portion of the partition wall, and passes into the accommodation chamber accommodating the compressor.

However, since only one refrigerant introduction passage is provided at the lower portion of the partition wall, it is incapable of cooling all the plurality of stators of the electric motor equally. As a result, under a condition in which a large load is applied to the electric compressor, insufficiently-cooled stators raise their temperature. This leads to a problem that the performances of the electric motor and the compressor are deteriorated.

SUMMARY OF THE INVENTION

The present invention has been made with the above-described conditions taken into consideration. Accordingly, a first object of the present invention is to provide an electric compressor capable of evenly and sufficiently cooling stators of an electric motor, and capable of preventing its performance from decreasing even when a large load is applied to the electric compressor.

A second object of the present invention is to provide an electric compressor capable of swirling up a lubricant sufficiently even when the amount of refrigerant delivered from a compressor is small, and capable of preventing insufficient lubrication by facilitating the circulation of the lubricant, as well as capable of decreasing the amount of dead oil.

To achieving the foregoing objects, a first aspect of the present invention is an electric compressor (1, 101, 201, 301, 501, 701) which includes: a compressor (3, 103, 203, 303, 503, 703) configured to compress a refrigerant, the compressor (3, 103, 203, 303, 503, 703) having a plurality of passage ports (7, 207) delivering the refrigerant; an electric motor (5, 105, 205, 305, 505) configured to drive the compressor (3, 103, 203, 303, 503, 703), the electric motor (5, 105, 205, 305, 505) having a plurality of stators (17) and an accommodation chamber (13, 213) accommodating the plurality of stators (17); a partition wall (15, 115, 215, 315) separating the compressor (3, 103, 203, 303, 503, 703) and the an accommodation chamber (13, 213) of the electric motor (5, 105, 205, 305, 505); and a plurality of refrigerant introducing/discharging passages (19, 119, 219, 319, 519) formed at the partition wall (15, 115, 215, 315) wherein the respective refrigerant introducing/discharging passages (19, 119, 219, 319, 519) are located in a circumferential direction of the accommodation chamber (13, 213), thereby the refrigerant being introduced into and discharged from stators (17) end in the electric motor (5, 105, 205, 305, 505) through the respective refrigerant introducing/discharging passages (19, 119, 219, 319, 519).

According to a second aspect of the present invention, as it depends from the first aspect, the electric compressor (201) is characterized in that two of the refrigerant introducing/discharging passages (219) are horizontally located at each left and right sides of the partition wall (215) at the portions correspond to the location of the passage ports (207), thereby connecting the passage ports (207) with the refrigerant introducing passages (219).

In the electric compressor according to the first and the second aspects of the present invention, the number of refrigerant introducing/discharging passages is same as the number of passage ports of the compressor so as to distribute the refrigerant into two ways. Through this distribution and allocation scheme, the present invention more reduces unevenness among the amounts of refrigerant allotted to the respective stators than the distribution and allocation scheme of the electric compressor in the related art in which the refrigerant is blown from only lower portion of the partition wall. Consequently, it is capable of cooling each stator evenly and sufficiently.

According to a third aspect of the present invention, as it depends from the first or the second aspects, the electric compressor (1, 101, 201, 301, 501, 701) is characterized by further comprising: a refrigerant circulation passage (11, 311) formed between the delivery ports (7) of the compressor (3, 103, 303, 503, 703) and the partition wall (15, 115, 315), thereby introducing the refrigerant from the passage ports (7) to the refrigerant circulation passage (11, 311) or introducing the refrigerant from the refrigerant circulation passage (11, 311) to the passage ports (7).

According to a fourth aspect of the present invention, as it depends from one aspect among the first to the third aspects, the electric compressor (1, 101, 201, 301, 501, 701) is characterized in that the refrigerant introducing/discharging passages (19, 119) are made of a plurality of round holes (19, 119), respectively; and that the number of the plurality of round holes (19, 119) is larger than the number of the passage ports (7).

In the electric compressor according to the third and the fourth aspects of the present invention, the refrigerant circulation passage is provided. Thus, through the refrigerant circulation passage, the refrigerant is distributed among the refrigerant introducing/discharging passages for cooling the stators, and the refrigerant thus distributed is then allotted to the stators in the electric motor. In this respect, the number of refrigerant introducing/discharging passages is larger than the number of passage ports. Through this distribution and allocation scheme, the present invention reduces unevenness among the amounts of refrigerant allotted to the respective stators. Consequently, the present invention is capable of enhancing the cooling efficiency through this distribution and allocation scheme in comparison with a scheme which lets the refrigerant delivered from the compressor flow to the stators as it is, and accordingly capable of cooling each stator evenly and sufficiently.

As a consequence, even under a condition in which a higher load is applied to the electric compressor, the present invention prevents the stators from raising their temperatures, and thus prevents the electric motor from decreasing its performance, which in turn keeps the performance of the compressor high.

According to a fifth aspect of the present invention, as it depends from one aspect among the first to the fourth aspects, the electric compressor (1, 101, 201, 301, 501, 701) is characterized in that the number of the refrigerant introducing/discharging passages (19, 119) is equal to the number of the stators (17).

In the electric compressor according to the fifth aspect of the present invention, since the same number of refrigerant introducing/discharging passages provided in the electric motor as the stators provided in the electric motor (for example, 9 refrigerant introducing/discharging passages are provided when 9 stators are provided in the electric motor), the stators are sufficiently cooled by the refrigerant introducing/discharging passages exclusively assigned to the stators, respectively. Consequently, even when a large load is applied to the electric compressor, the present invention prevents the stators from raising their temperatures, and also prevents the electric motor from decreasing its performance, thereby keeping the performance of the compressor high.

According to a sixth aspect of the present invention, as it depends from one aspect among the first to the fifth aspects, the electric compressor (1, 101, 201, 301, 501, 701) is characterized in that the refrigerant introducing/discharging passages (19, 119) are arranged to face the respective stators (17).

According to a seventh aspect of the present invention, as it depends from one aspect among the first to the sixth aspects, the electric compressor (1, 101, 201, 301, 501, 701) is characterized in that each refrigerant introducing/discharging passage (319, 519) is made of a long hole (319, 519) continuing in the circumferential direction.

According to a eighth aspect of the present invention, as it depends from one aspect among the first to the seventh aspects, the electric compressor (1, 101, 201, 301, 501, 701) is characterized in that the refrigerant introducing/discharging passages (319, 519) are respectively made of two long holes (319, 519) bow-shaped along the circumferential direction.

According to a ninth aspect of the present invention, as it depends from one aspect among the first to the eighth aspects, the electric compressor (1, 101, 201, 301, 501, 701) is characterized in that a width of each refrigerant introducing/discharging passage (319, 519) is smaller than a diameter of each passage port (7) in the compressor (3); and that a part of each refrigerant introducing/discharging passage (319, 519) is located inside its corresponding passage port (7).

In the electric compressor according to the sixth to the ninth aspects of the present invention, since the refrigerant introducing/discharging passages are arranged to face the respective stators, the refrigerant is directly blown to the stators from the refrigerant introducing/discharging passages exclusively assigned to the stators. Thereby, the present invention causes the stators to be evenly and sufficiently cooled. Consequently, even when a large load is applied to the electric compressor, the present invention prevents the stators from raising their temperatures, and also prevents the electric motor from decreasing its performance, thereby keeping the performance of the compressor high.

According to a tenth aspect of the present invention, as it depends from one aspect among the first to the ninth aspects, the electric compressor (1, 101, 201, 301, 501, 701) is characterized in that the refrigerant introducing/discharging passages (19, 119, 519) include: lower refrigerant introducing/discharging passages (19, 119, 519*b*, 519*d*) provided respectively in locations below a horizontal cross-section (555) of the widest portion of the electric motor (5, 105, 505); and upper refrigerant introducing/discharging passages (19, 519*a*) provided respectively in locations above the cross-section (555); and that a total of vertical cross-sectional areas respectively of the lower refrigerant introducing/discharging passages (19, 119, 519*b*, 519*d*) is set larger than a total of vertical cross-sectional areas respectively of the upper refrigerant introducing/discharging passages (19, 519*a*).

According to an eleventh aspect of the present invention, as it depends from one aspect among the first to the tenth aspects, the electric compressor (1, 101, 201, 301, 501, 701) is characterized in that a diameter of the round hole of the lower refrigerant introducing/discharging passage (119) is larger than the diameter of the round hole of the upper refrigerant introducing/discharging passage (19).

According to an twelfth aspect of the present invention, as it depends from one aspect among the first to the eleventh aspects, the electric compressor (1, 101, 201, 301, 501, 701) is characterized in that the refrigerant introducing/discharging passages (519) are respectively made of two long holes (519) each having an arc shape and provided in a way to continue from an upper location to a lower location in the circumferential direction of the accommodation chamber (13) of the electric motor (505); and that an expanded diameter part (519*c*, 519*d*) is provided to a lower end portion of each of the long holes (519) of the refrigerant introducing/discharging passages (519) so that the expanded diameter part (519*c*, 519*d*) causes a total vertical cross-sectional area of the lower refrigerant introducing/discharging passages (19, 119, 519*b*, 519*d*) is larger than a total vertical cross-sectional areas of the upper refrigerant introducing/discharging passages (19, 519*a*).

In the electric compressor according to the tenth to the twelfth aspects of the present invention, the total of the vertical cross-sectional areas of refrigerant introducing passages provided in locations below a horizontal cross-section of the widest portion of the electric motor is set larger than that in locations above the horizontal cross-section. For this reason, even when a small amount of refrigerant is delivered from the compressor, the electric compressor is capable of blowing an sufficient amount of refrigerant to a lower portion of the electric motor in which a lubricant would otherwise tend to remain stagnant, and accordingly capable of facilitating circulation of the lubricant by swirling up the lubricant from the lower portion of the electric motor.

Thus, the electric compressor prevents insufficient lubrication of bearings and the like, and largely reduces the amount of dead oil which would otherwise remain stagnant in the lower portion of the electric motor. As a result, the electric compressor is capable of reducing the amount of lubricant to be filled, and thus reducing the costs needed therefor.

Note that, in the case of the present invention, the total of the vertical cross-sectional areas of the lower refrigerant introducing passages is compared with the total of the vertical cross-sectional areas of the upper refrigerant introducing passages depending on the number of refrigerant introducing passages provided in the lower locations and the in the upper locations, as well as depending on the vertical cross-sectional area of each refrigerant introducing passage provided in its lower location and the vertical cross-sectional area of each refrigerant introducing passage provided in its upper location. Cases to which the present invention is applicable include a case in which no refrigerant introducing passage is provided in any upper location.

BRIEF DESCRIPTION OF THE ACCOMPANYING DRAWINGS

The above and further objects and novel features of the present invention will more fully appear from the following detailed description when the same is read in conjunction with the accompanying drawings, in which.

DETAILED DESCRIPTION OF THE PREFERRED EMBODIMENTS

Embodiment 1

Figure 1:
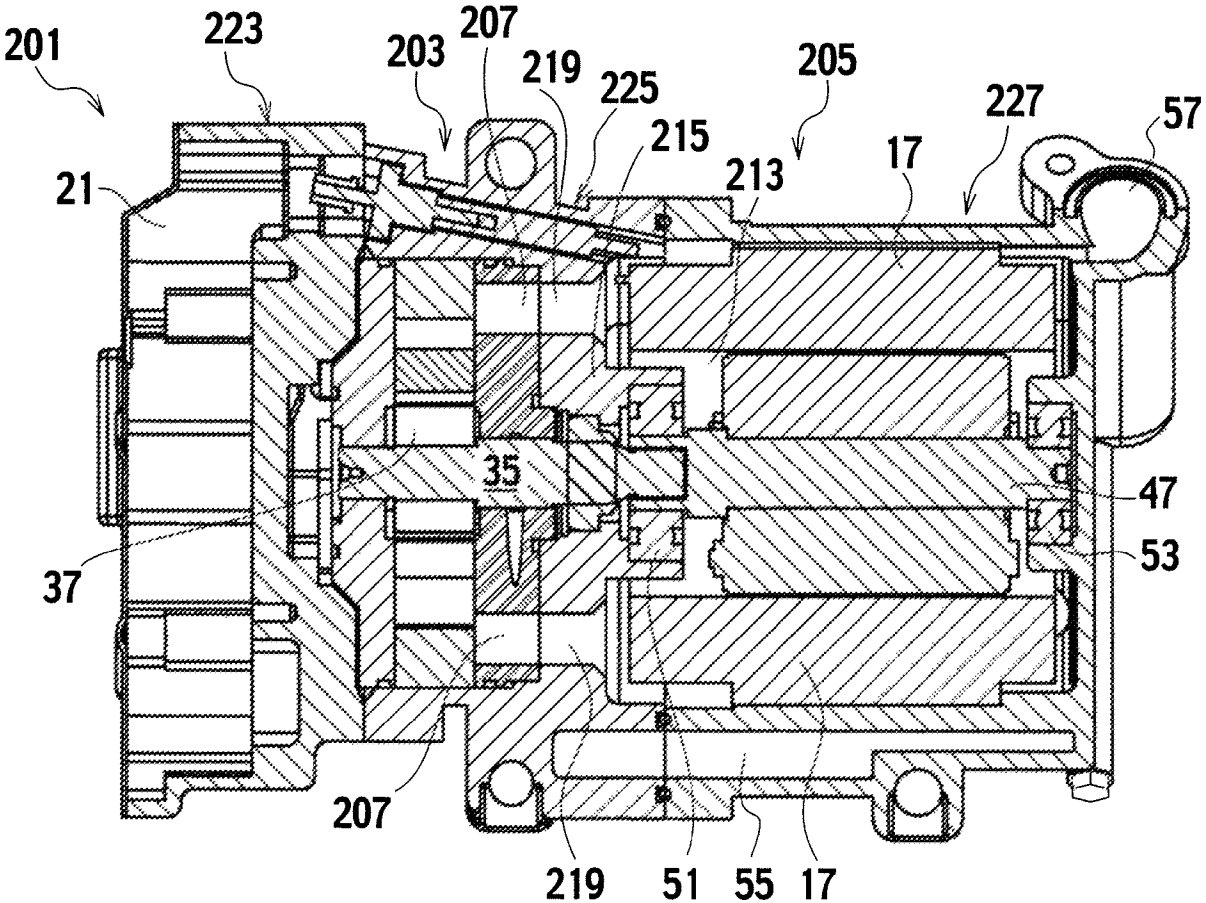
FIG. 1 is a longitudinal cross-sectional view of an electrical compressor according to Embodiment 1 of the present invention.
Figure 2:
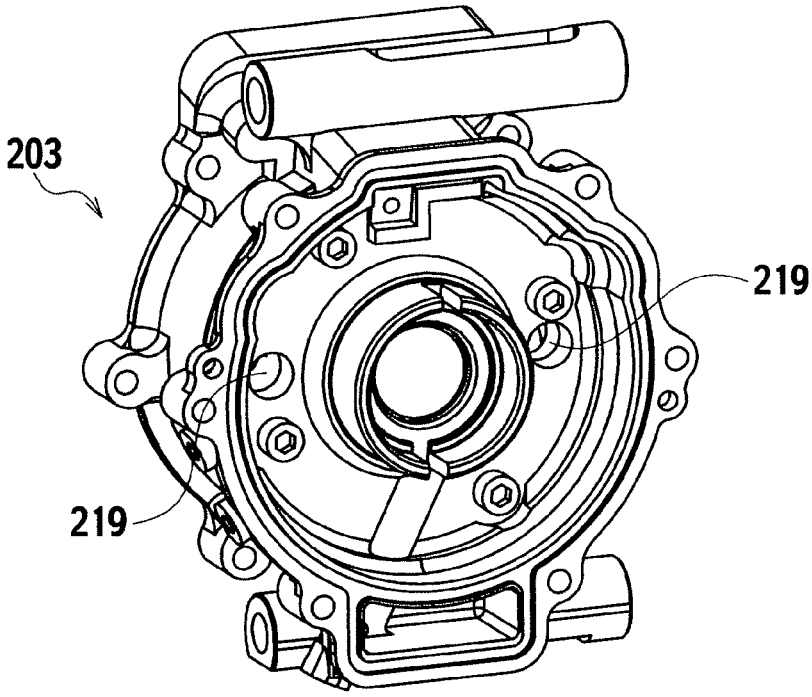
FIG. 2 is a perspective view of a compressor constituting the electric compressor.
Figure 3:
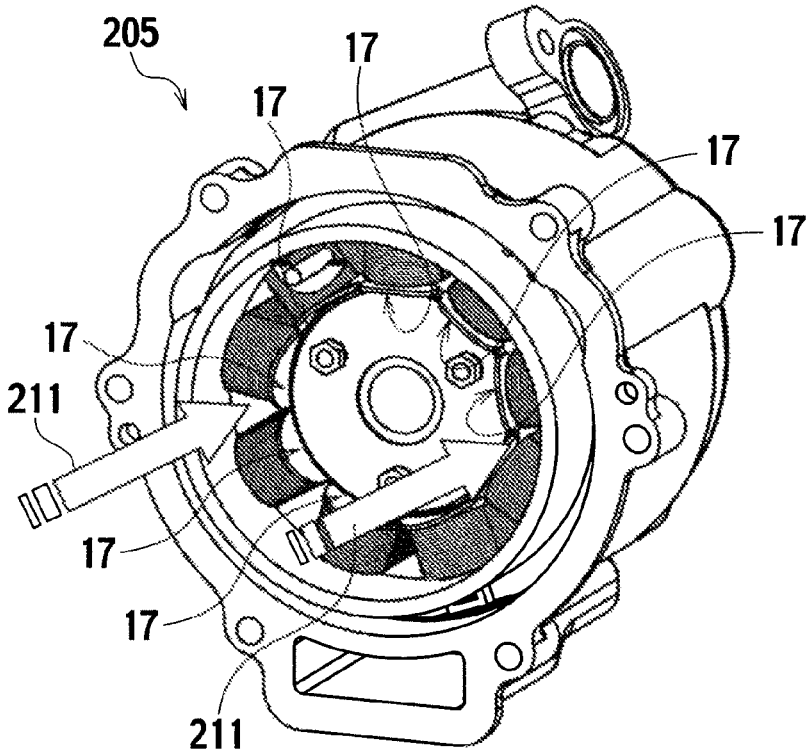
FIG. 3 is a perspective view of an electric motor constituting the electric compressor.

Descriptions will be provided for an electric compressor 201 according to Embodiment 1 of the present invention by referring to FIGS. 1 to 3.

The electric compressor 201 is used in a cooling system for a vehicle air conditioner. Refrigerant (coolant) gas is adiabatically compressed by the electric compressor 201, and becomes high in temperature and pressure. Afterward, this refrigerant is liquefied by a condenser. Subsequently, the refrigerant thus liquefied is pressed and expanded by an expansion valve. After that, through heat exchange by an evaporator, the refrigerant is heated and evaporated while cool air is generated. Afterward, the refrigerant returns to the electric compressor 201, and is adiabatically compressed again. The amount of refrigerant delivered from the electric compressor 201 is regulated depending on change in heat load applied to the cooling system. Incidentally, a suitable amount of lubricant is mixed into the refrigerant.

The electric compressor 201 is configured of: the compressor 203 (a vane compressor); the electric motor 205; a drive circuit 21 configured to control the number of revolutions of the electric motor 205 depending on the change in heat load; and the like. The drive circuit 21 is accommodated in a front housing 223. The compressor 203 is accommodated in a middle housing 225. The electric motor 205 is accommodated in a rear housing 227. The housings 223, 225, 227 are fixed to each other with bolts.

The electric compressor 201 includes a plurality of delivery ports 207 (passage ports). The electric compressor 201 further includes a partition wall 215 separating an accommodation chamber 213 accommodating the electric motor 205 and the compressor 203. The partition wall 215 is formed with refrigerant introducing passages 219 (refrigerant introducing/discharging passages 219) so as to introduce the refrigerant delivered from the delivery ports 207. According to the embodiment, as shown in FIG. 2, Two of the refrigerant introducing passages 219 are separatedly located at each left and right sides of the partition wall 215 and at the middle height of the partition wall 215. The location of the refrigerant introducing passages 219 correspond to the location of the delivery ports 207.

Here, the refrigerant introducing passages 219 drawn in FIG. 1 are expressed so as to be located in the vertical direction according to convenient expression of the drawing in the longitudinal cross-sectional view of the electric compressor 201. However, actual locations of the refrigerant introducing passages 219 are arranged in a manner such that the two refrigerant introducing passages 219 are separatedly located at each left and right sides of the partition wall 215 and at the middle height of the partition wall 215 as shown in FIG. 2 and as previously described.

Revolutions of the electric motor 205 are transmitted from the motor shaft 47 to the rotor shaft 35 (the rotor 37), and thus drive the compressor 203. The compressor 203 delivers a compressed refrigerant to the refrigerant introducing passages 219 as shown in FIG. 2. Subsequently, as shown in FIG. 3, the refrigerant thus distributed are blown from the refrigerant introducing passages 219 to the stators 17 facing the respective refrigerant introducing passages 219. The refrigerant thus blown cools the respective stators 17.

An oil reservoir 55 is provided in the lower portion of each of the middle housing 225 and the rear housing 227. Oil is supplied from the oil reservoir 55 to parts needed to be lubricated, such as the supporting parts of the rotor 35 and the bearings 51 and 53. Consequently, such parts are lubricated and cooled down with the oil. The oil is pooled in the lower portion of the accommodation chamber 213 of the electric motor 205. The refrigerant having been flown from the refrigerant introducing passages 219 to the accommodation chamber 213 cools the respective stators 17. Subsequently, an oil separator separates oil from the refrigerant. Thereafter, the resultant refrigerant is delivered from a delivery port 57 of the rear housing 227, and is sent to the condenser side.

In the electric compressor 201 according to Embodiment 1 of the present invention, the stators 17 of the electric motor 205 are cooled down by a refrigerant 211 blown to the stators 17 of the electric motor 205 from the refrigerant introduction passage 219 as indicated by arrows 211 in FIG. 3.

However, only two refrigerant introduction passages 219 are provided for the nine (9) stators 17 in the electric compressor 201. Thus, as shown in FIG. 3, the flow of the refrigerant 211 toward the stators 17 becomes uneven, meaning that, the refrigerant 211 cannot be blown equally to all the stators 17, and is therefore incapable of cooling all the stators 17 equally.

As a result, under a condition in which a large load is applied to the electric compressor 201, insufficiently-cooled stators 17 raise their temperature. This leads that the performances of the electric motor 205 and the compressor 203 are deteriorated.

On the other hand, when the amount of refrigerant delivered from the compressor 203 is small, the amount of refrigerant blown to the lower portion of the electric motor 205 decreases particularly. As a result, the refrigerant's function of swirling up the lubricant decreases, and accordingly the amount of lubricant circulated. This makes it likely that members (such as bearings) located may be lubricated insufficiently, and that the lubricant may become stagnant in the lower portion of the electric motor 205. For this reason, the amount of lubricant filled in the electric motor needs to be increased.

In this connection, the inventors of the present inventions have improved the electric compressor 201 according to Embodiment 1 of the present invention as another electric compressor 1 according to Embodiment 2 of the present invention described hereinbelow.

Embodiment 2

Descriptions will be provided for an electric compressor 1 according to Embodiment 2 of the present invention by referring to FIGS. 4 to 8. Note that the same components as those in Embodiment 1 will be denoted by the same reference numerals, and that duplicated descriptions for those components will be omitted.

The electric compressor 1 includes: a compressor 3 (a vane compressor) configured to compress a refrigerant; and an electric motor 5 configured to drive the compressor 3. The electric compressor 1 is that wherein: a refrigerant circulation passage 11 is provided into or out of which the refrigerant 9 (see FIG. 8) delivered from delivery ports 7 (passage ports) in the compressor 3 flows; and refrigerant introducing passages (refrigerant introducing/discharging passages) 19 for introducing a refrigerant 9 to stators 17 of the electric motor 5 so as to cool the stators 17, are provided in a partition wall 15 between an accommodation chamber 13 of the electric motor 5 and a refrigerant circulation passage 11; the refrigerant introducing/discharging passages 19 are provided more than the delivery ports 7; the refrigerant introducing passages 19 are provided as many as the stators 17; and the refrigerant introducing/discharging passages 19 are arranged to face the respective stators 17.

Next, descriptions will be provided for a structure of the electric compressor 1.

The electric compressor 1 is used in a cooling system for a vehicle air conditioner. Refrigerant gas is adiabatically compressed by the electric compressor 1, and becomes high in temperature and pressure. Afterward, this refrigerant is liquefied by a condenser. Subsequently, the refrigerant thus liquefied is pressed and expanded by an expansion valve. After that, through heat exchange by an evaporator, the refrigerant is heated and evaporated while cool air is generated. Afterward, the refrigerant returns to the electric compressor 1, and is adiabatically compressed again. The amount of refrigerant delivered from the electric compressor 1 is regulated depending on change in heat load applied to the cooling system. Incidentally, a suitable amount of lubricant is mixed into the refrigerant.

The electric motor 1 is configured of: the compressor 3; the electric motor 5; a drive circuit 21 configured to control the number of revolutions of the electric motor 5 depending on the change in heat load; and the like. The drive circuit 21 is accommodated in a front housing 23. The compressor 3 is accommodated in a middle housing 25. The electric motor 5 is accommodated in a rear housing 27. The housings 23, 25, 27 are fixed to each other with bolts.

The compressor 3 is configured of a front block 29, a cylinder block 31, a rear block 33, a rotor shaft 35, a rotor 37, multiple vanes 39 and the like. The blocks 29, 31, 33 are fixed to the middle housing 25 with bolts. The left end portion and the center portion of the rotor shaft 35 are rotatably supported by the front block 29 and the rear block 33, respectively. A cylinder chamber 41 is formed in the cylinder block 31. The cross-section of the inner perimeter of the cylinder chamber 41 is almost elliptic. The rotor shaft 35 is arranged concentric with this elliptic cross section. The rotor 37 is fixed to the rotor shaft 35. The vanes 39 are movably supported by the respective vane grooves each extending in the radial direction of the rotor 37. The vane grooves are provided to the rotor 37 in equal intervals in the circumferential direction of the rotor 37.

Multiple pump chambers are formed among the cylinder chamber 41, the outer circumferential surface of the rotor 37 and the vanes 39. Once the rotor 37 starts to rotate in response to the drive of the compressor 3, the vanes 39 receive their centrifugal forces and the back pressures supplied to the bottoms of their corresponding vane grooves, respectively. Thereby the vanes 39 move in the radial direction of the rotor 37 while sliding their vertex portions on the cylinder chamber 41. Capacities of the pump chambers change depending on the rotation of the rotor 37 and the respective movements of the vanes 39 in the radial direction of the rotor 37. A refrigerant suctioning stroke, refrigerant compressing stroke and refrigerant delivering stroke are alternately repeated in response to the change in the capacity of each pump chamber. In the refrigerant suctioning stroke, the refrigerant is suctioned from a refrigerant suctioning passage 43. In the refrigerant delivering stroke, the refrigerant having compressed in the corresponding refrigerant compressing stroke is delivered to the delivery ports 7.

Figure 4:
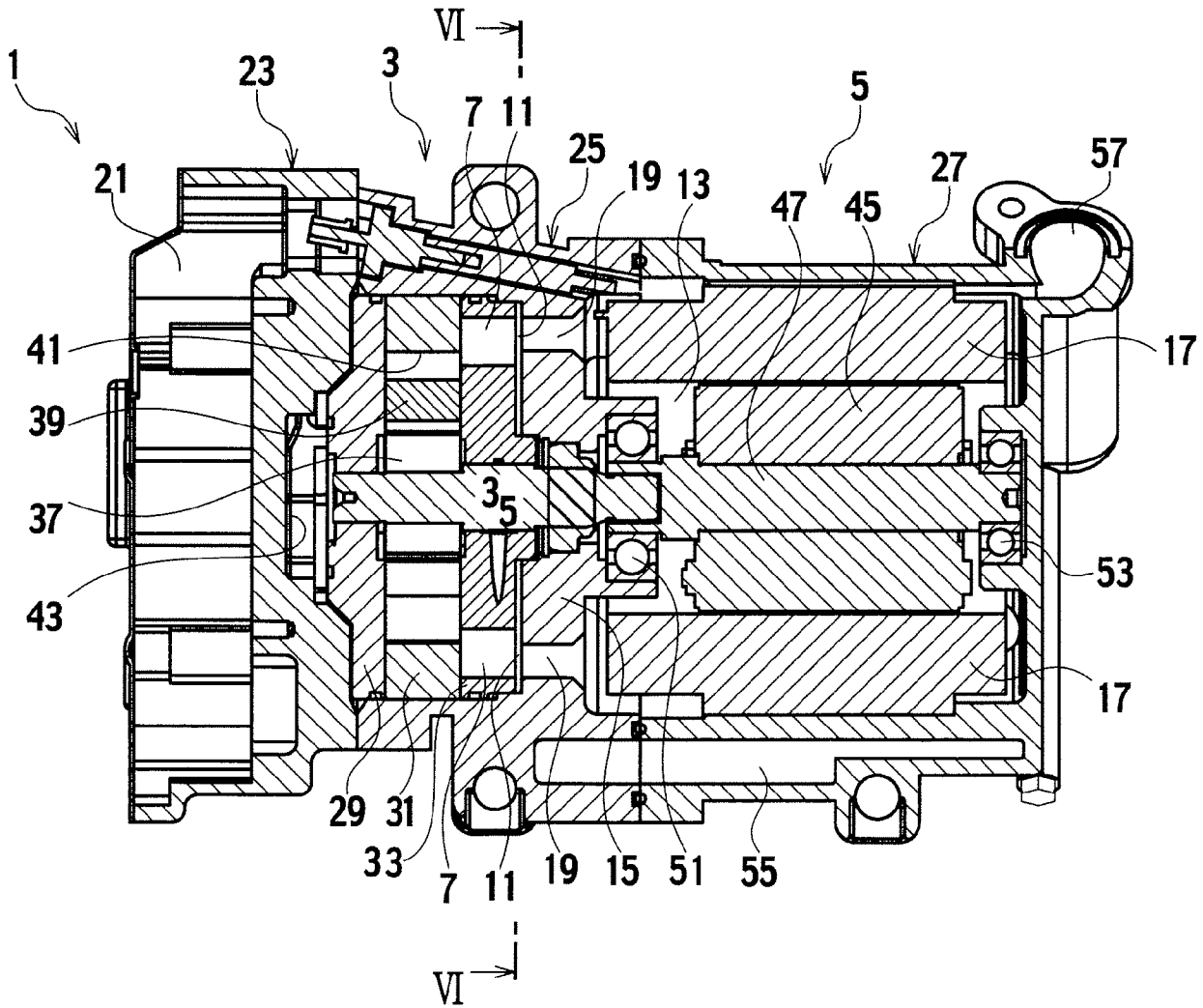
FIG. 4 is a longitudinal cross-sectional view of an electric compressor according to Embodiment 2 of the present invention.
Figure 8:
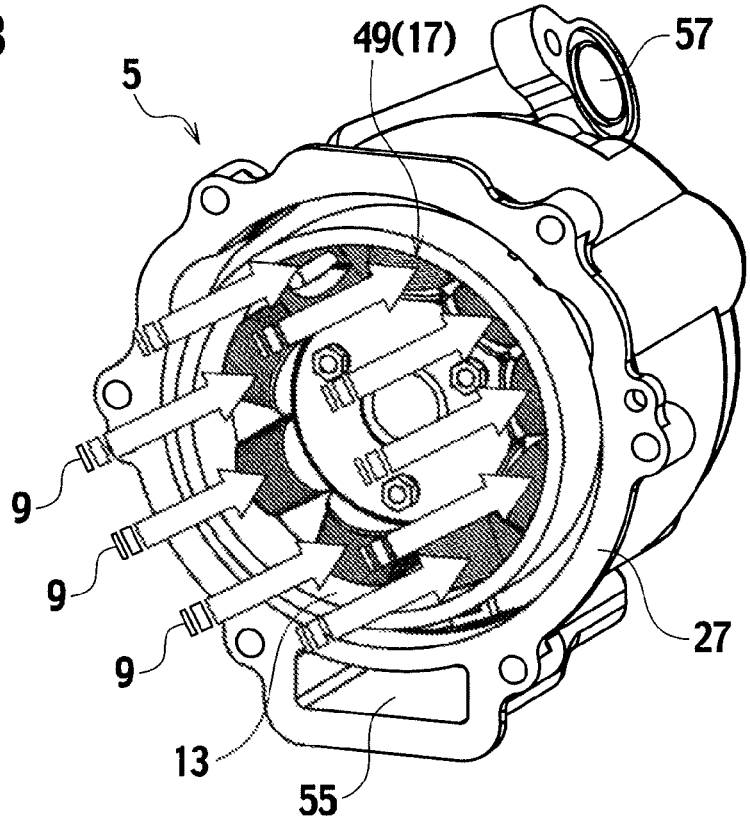
FIG. 8 is a perspective view of an electric motor.
Figure 9:
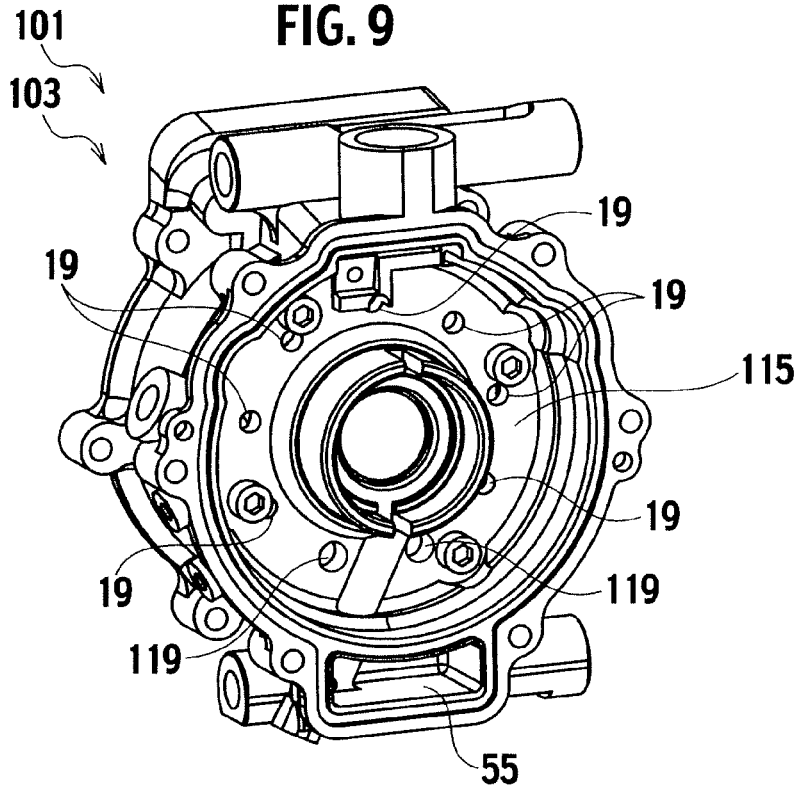
FIG. 9 is a perspective view of a compressor constituting an electric compressor according to Embodiment 3 of the present invention.

The electric motor 5 is configured of the stators 17, a rotor 45 made of a magnetic material, a motor shaft 47, and the like. Each stator 17 is made by winding a coil 49 (see FIG. 8) around a ferromagnetic core. As shown in FIGS. 4 and 8, 9 stators 17 are fixed to an inner periphery of the rear housing 27 in a way to be arranged in the circumferential direction thereof. The rotor 45 is press-fitted and fixed onto the motor shaft 47. The left end portion of the motor shaft 47 is connected to the right end portion of the rotor shaft 35 of the compressor 3. The left end portion of the motor shaft 47 together with the right end portion of the rotor shaft 35 is supported by the middle housing 25 with ball bearings 51. The right end portion of the motor shaft 47 is supported by the rear housing 27 with a ball bearing 53.

Figure 5:
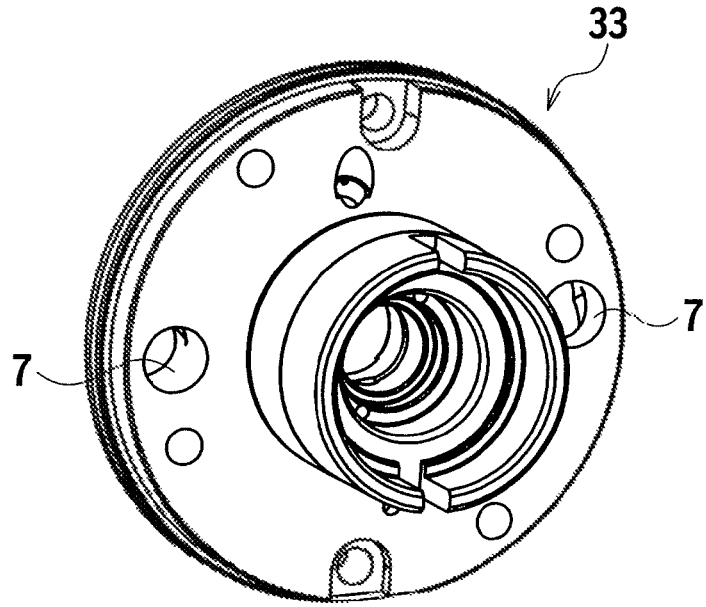
FIG. 5 is a perspective view of a rear block constituting a compressor.
Figure 6:
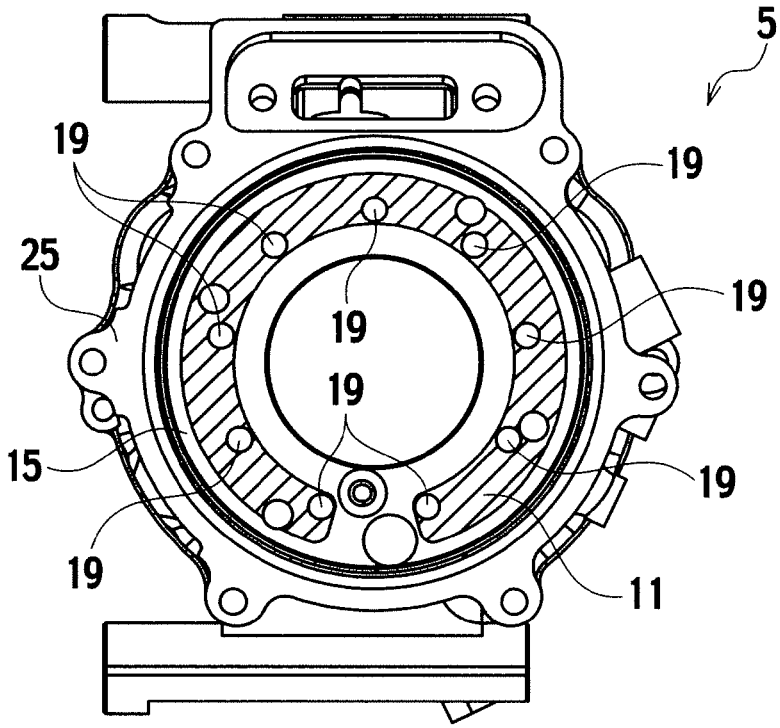
FIG. 6 is an auxiliary cross-sectional view of the electric compressor taken along the VI-VI line of FIG. 4.
Figure 7:
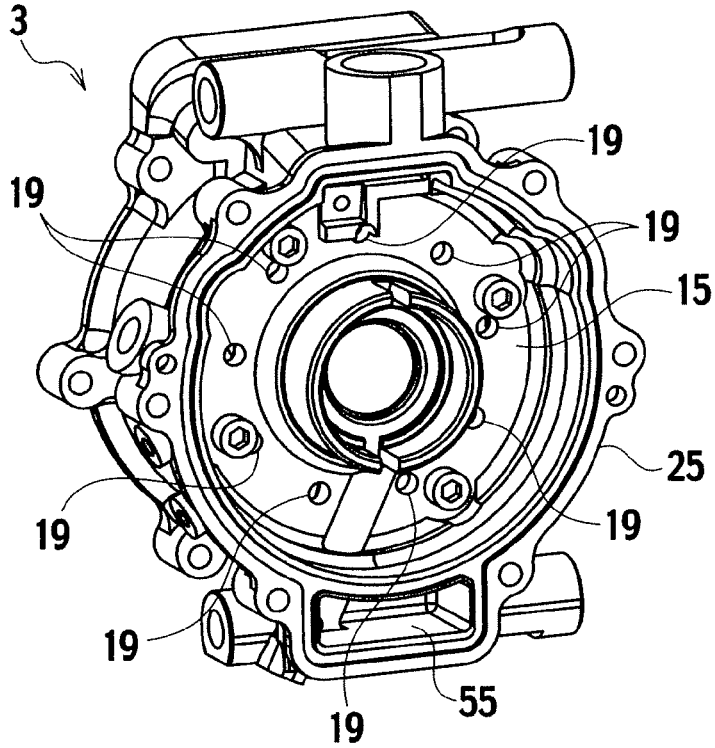
FIG. 7 is a perspective view of the compressor.

Two delivery ports 7 are provided in the rear block 33 in equal intervals in the circumferential direction of the rear block 33. As shown in FIGS. 6 and 7, the partition wall 15 is formed in the middle housing 25. Nine (9) refrigerant introducing passages 19 (the same amount of the stators 17) are provided in the partition wall 15 in equal intervals in the circumferential direction of the partition wall 15. The refrigerant introducing passages 19 are arranged so as to face the respective stators 17. As shown in FIGS. 4 to 6, the refrigerant circulation passage 11 is formed between the rear block 33 and the middle housing 25 (the partition wall 15), and causes the 2 delivery ports 7 to communicate with the 9 refrigerant introducing passages 19.

Revolutions of the electric motor 5 are transmitted from the motor shaft 47 to the rotor shaft 35 (the rotor 37), and thus drive the compressor 3. The compressor 3 delivers a compressed refrigerant to the delivery ports 7. The refrigerant thus delivered flows into the refrigerant circulation passage 11. As shown in FIGS. 6 and 7, the refrigerant having flown into the refrigerant circulation passage 11 is distributed among the 9 refrigerant introducing passages 19. Subsequently, as shown in FIG. 8, the refrigerant thus distributed are blown from the refrigerant introducing passages 19 to the 9 stators 17 facing the respective refrigerant introducing passages 19. The refrigerant thus blown cools the respective stators 17.

An oil reservoir 55 is provided in the lower portion of each of the middle housing 25 and the rear housing 27. Oil is supplied from the oil reservoir 55 to parts needed to be lubricated, such as the supporting parts of the rotor 35 and the bearings 51 and 53. Consequently, such parts are lubricated and cooled down with the oil. The oil is pooled in the lower portion of the accommodation chamber 13 of the electric motor 5. The refrigerant having been flown from the refrigerant introducing passages 19 to the accommodation chamber 13 cools the respective stators 17. Subsequently, an oil separator separates oil from the refrigerant. Thereafter, the resultant refrigerant is delivered from a delivery port 57 of the rear housing 27, and is sent to the condenser side.

Next, descriptions will be provided for effects of the electric compressor 1.

The electric compressor 1 causes the refrigerant delivered from the two delivery ports 7 to be distributed through the refrigerant circulation passage 11 among the 9 refrigerant introducing passages 19, and to allot the thus distributed refrigerant to the stators 17, the number of which is equal to the number of the refrigerant introducing passages 19. Thereby, the electric compressor 1 prevents the refrigerant from being given unevenly to the stators 17. Furthermore, the refrigerant introducing passages 19 are exclusively assigned to the respective 9 stators 17, and arranged to face to the respective stators 17. Thereby, the each of the 9 stators 17 is equally and sufficiently cooled down.

Consequently, even under a condition in which a large load is applied to the electric compressor 1, the electric compressor 1 is capable of preventing the stators 17 from raising their temperatures, and of preventing the electric motor 5 from decreasing its performance, hence keeping the performance of the compressor 3 high.

In addition, because of the structure according to the present invention in which the number of refrigerant introducing passages is larger than the delivery ports, the number of the refrigerant introducing passages arranged in the lower portion of the electric motor which portion is located lower in the gravitational direction increases inevitably. For this reason, oil (dead oil), which would otherwise remain stagnant in the lower portion of the electric motor, is effectively swirled up by the flow of the refrigerant, and is accordingly circulated again. Consequently, the lubricating and cooling effects of the refrigerant can be enhanced, and thus makes it possible to decrease the amount of oil to be filled in the inside of the electric compressor, which in turn reduces the costs required therefor.

Other Aspects Included in the Scope of the Present Invention

It should be noted that the present invention shall not be understood as being limited to the foregoing embodiment. The present invention can be variously modified within its technical scope.

A compressor to be employed to the present invention is not limited to the vane compressor, and any other type of compressor may be employed. In any case, a compressor can be employed as long as the number of refrigerant introducing passages is larger than the delivery ports.

For instance, the foregoing embodiment shows the example in which the 9 (not less than 3) refrigerant introducing passages 19 are provided to the vane compressor 3 including the two delivery ports 7. However, if a vane compressor has three delivery ports, then four or more refrigerant introducing passages should be provided thereto. In addition, if a scroll compressor has one delivery port, then two or more refrigerant introducing passages should be provided thereto.

In the foregoing embodiment, the delivery ports 7 are provided as passage ports, and the refrigerant introducing passages 19 are provided as refrigerant introducing/discharging passages, in the electric compressor in which the refrigerant is introduced into the accommodation chamber 13 from the refrigerant suctioning passage 43 through the delivery ports 7, and in which the resultant refrigerant is then delivered from the delivery port 57. Instead, the present invention can be applied to an electric compressor modified in such a manner that the refrigerant is introduced into the accommodation chamber 13 of the electric motor 5 from the delivery port 57, and in which the refrigerant thus introduced is discharged from the delivery ports 7 and is subsequently delivered to the refrigerant suctioning passage 43. This modification of the electric compressor according to the present invention can be also applied to the electric compressors according to the Embodiments 1 and 2 previously described, and to the Embodiment 3 to the Embodiment 6 described hereinbelow.

Here, the inventors of the present inventions have further improved the electric compressors 1 and 201 according to Embodiments 1 and 2 of the present invention as still another electric compressors 101, 301, 501 and 701 according to Embodiments 3 to 6 of the present invention described hereinafter.

Embodiment 3

Figure 10:
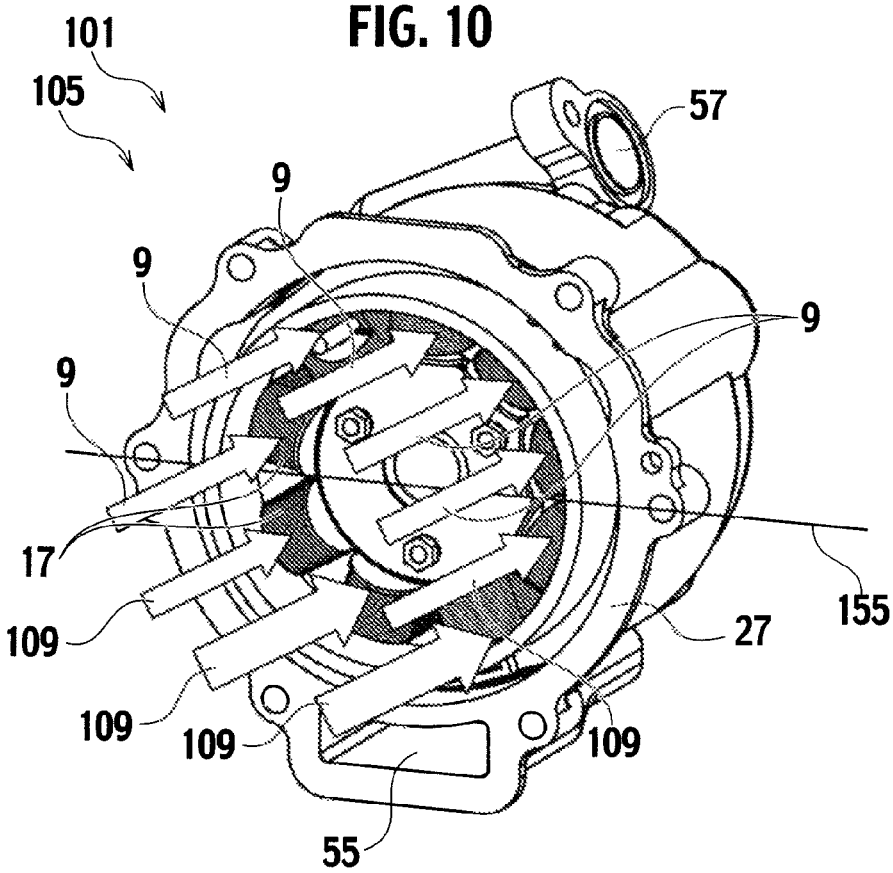
FIG. 10 is a perspective view of an electric motor constituting the electric compressor according to Embodiment 3 of the present invention.

Descriptions will be provided for an electric compressor 101 according to Embodiment 3 by referring to FIGS. 9 and 10. Note that the same components as those in Embodiments 1 and 2 will be denoted by the same reference numerals, and that duplicated descriptions for those components will be omitted.

As shown in FIG. 9, two refrigerant introducing passages 19 are provided in two locations lower than the cross-section of the widest section of the electric compressor 101 in the horizontal direction 155 shown in FIG. 10, whereas 5 refrigerant introducing passages 19 are provided in 5 locations higher than the cross-section. In addition, two other refrigerant introducing passages 119 are provided in two locations lower than the locations of the two refrigerant introducing passages 19 provided in the respective lower locations. Each refrigerant introducing passage 119 has a wider cross-sectional area than each refrigerant introducing passage 19. Note that the cross-sectional area of each narrower refrigerant introducing passage 19 provided in the respective lower locations is equal to that of each refrigerant introducing passage 19 provided in the respective upper locations. As described above, the four refrigerant introducing passages in total which include the two refrigerant introducing passages 19 and the two refrigerant introducing passages 119 are provided in the respective lower locations. Indeed, the number of refrigerant introducing passages in the respective lower locations is smaller than 5 which is the number of refrigerant introducing passages 19 in the respective upper locations. However, a total of the cross-sectional areas of the refrigerant introducing passages 19, 119 in the lower locations is larger than a total of the cross-sectional areas of the refrigerant introducing passages 19 provided in the upper locations. That is because the two refrigerant introducing passages 119 each with the wider cross-sectional area are provided in the lower locations.

Consequently, a larger amount of refrigerant is blown, as indicated by arrows 109, to the stators 17 provided in the lower locations respectively from the refrigerant introducing passages 19 and the refrigerant introducing passages 119 provided in the lower locations, compared to an amount of refrigerant blown, as indicated by arrows 9, to the stators 17 provided in the upper locations from the respective refrigerant introducing passages 19 provided in the upper locations.

As described above, the larger amount of refrigerant is blown to the lower portion of the rear housing 27 than the upper portion of the rear housing 27. For this reason, lubricant oil can be sufficiently swirled up and therefore circulated sufficiently, which would otherwise tend to remain stagnant in the lower portion of the rear housing 27.

Next, descriptions will be provided for the effects of the electric compressor 101.

The total cross-sectional areas of the refrigerant introducing passages 19 and 119 in the lower locations are designed to be larger than the total cross-sectional areas of the refrigerant introducing passages 19 in the upper locations. For this reason, even when the amount of refrigerant delivered from the compressor 103 is small, the electric compressor 101 is capable of blowing a sufficient amount of refrigerant to the lower portion of the electric motor 105 in which the lubricant would otherwise tend to remain stagnant, hence swirling up the lubricant. Consequently, the electric compressor 101 is capable of facilitating circulation of the lubricant, and exerting the lubricating and cooling functions of the lubricant.

Accordingly, the electric compressor 101 prevents the insufficient lubrication of ball bearings 51 and 53, and largely reduces the amount of lubricant (dead oil) which remains stagnant in the lower portion of the electric motor 105. Therefor, the electric compressor 101 can reduce the amount of oil to be filled therein, and hence reducing the costs needed therefor.

In addition, the refrigerant delivered from the two delivery ports 7 is distributed among the refrigerant introducing passages 19, 119 via the refrigerant circulation passage 11, and the refrigerant thus distributed is then allotted to the stators 17. Thereby, an almost equal amount of refrigerant is blown to each stator 17. Furthermore, the refrigerant introducing passages 19 and 119 are exclusively and assigned to the respective 9 stators 17, and the refrigerant introducing passages 19 and 119 are arranged to face the respective stators 17. Thereby, the electric compressor 101 evenly and sufficiently cools the 9 stators 17.

Consequently, even when a larger load is applied to the electric compressor 101, the electric compressor 101 is capable of preventing the stators 17 from raising their temperatures, and of preventing the electric motor 105 from decreasing its performance, hence keeping the performance of the compressor 103 high.

Other Aspects Included in the Scope of the Present Invention

The present invention shall not be understood as being limited to the foregoing embodiment. The present invention can be variously modified within its technical scope.

For example, this aspect of the present invention in which the total cross-sectional areas of the refrigerant introducing passages provided in the lower locations are larger than the total cross-sectional areas of the refrigerant introducing passages provided in the upper locations, includes: an aspect in which the number of refrigerant introducing passages provided in the lower locations is larger than the refrigerant introducing passages provided in the upper locations; an aspect in which refrigerant introducing passages each having a larger cross-sectional area are provided in the respective lower locations; an aspect obtained by combining these two aspects; and an aspect in which no refrigerant introducing passage is provided in any upper location.

A compressor to be employed to the present invention is not limited to the vane compressor. The present invention may be employed to any other type of compressor. In any case, a compressor is employable as long as the total cross-sectional areas of the refrigerant introducing passages provided in the respective lower locations are set larger than the total cross-sectional areas of the refrigerant introducing passages provided in the respective upper locations.

Embodiment 4

Descriptions will be provided for an electric compressor 301 according to Embodiment 4 by referring to FIGS. 11 to 14. Note that the same components as those in Embodiments 1 and 2 will be denoted by the same reference numerals, and that duplicated descriptions for those components will be omitted.

Figure 12:
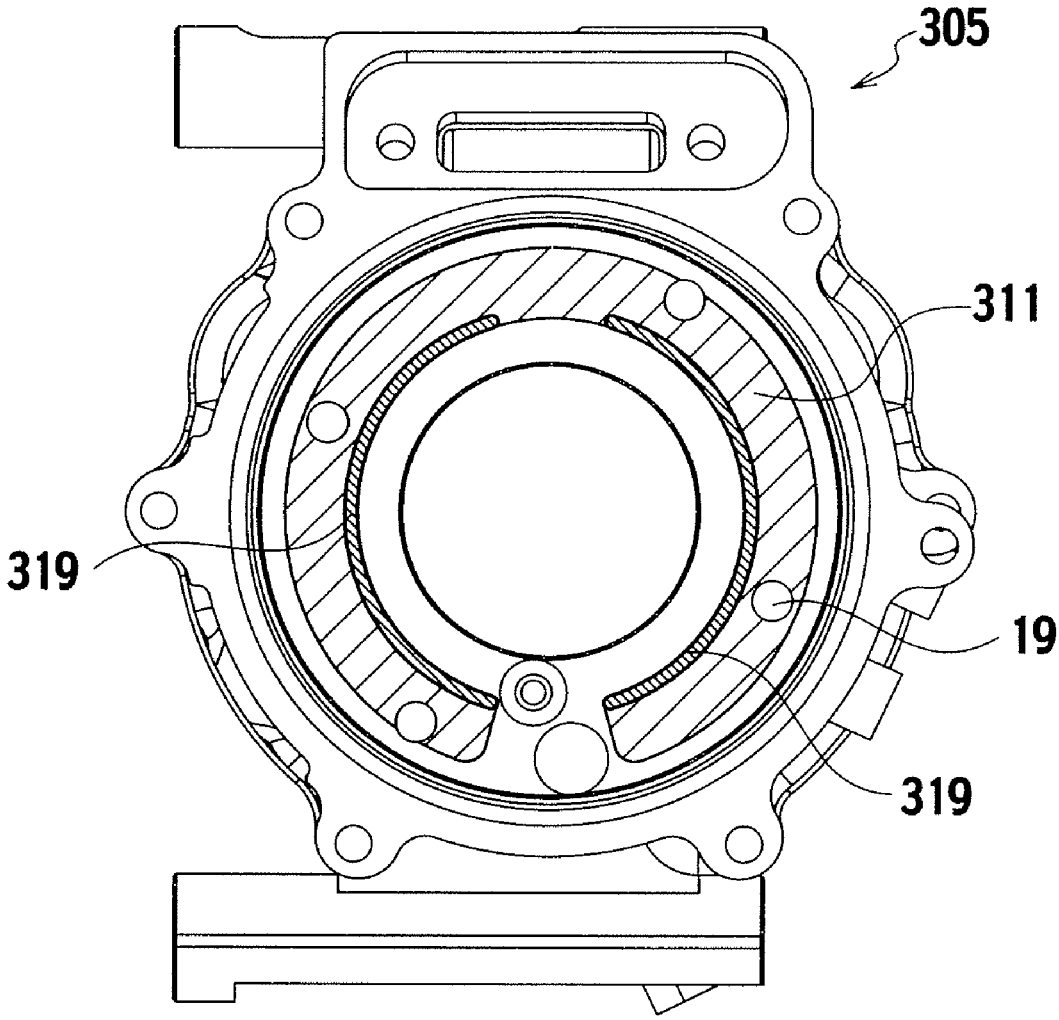
FIG. 12 is an auxiliary cross-sectional view of the electric compressor taken along the XII-XII line of FIG. 11.
Figure 13:
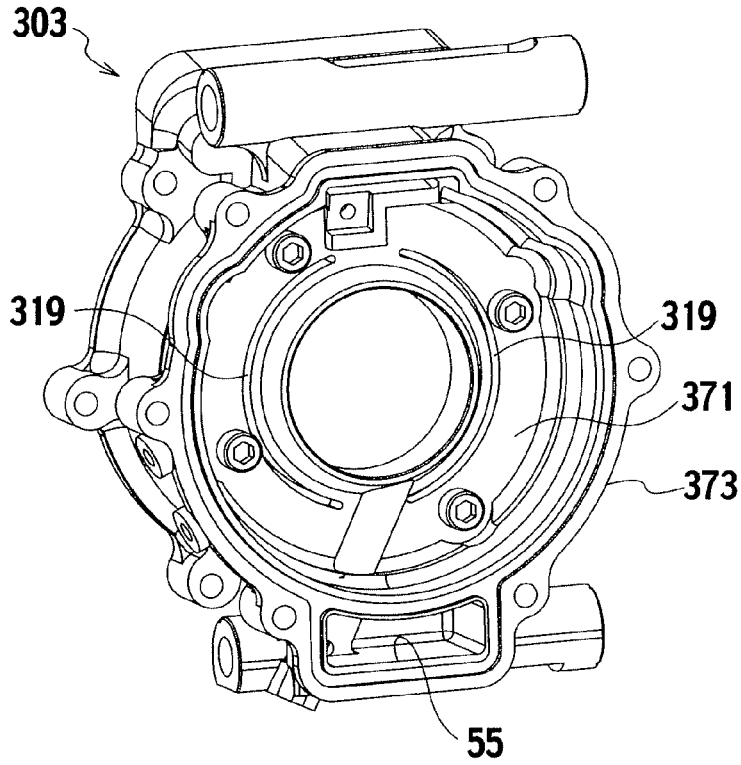
FIG. 13 is a perspective view of a compressor constituting the electric compressor according to Embodiment 4 of the present invention.

In the case of this embodiment, as shown in FIGS. 12 and 13, two long holes 319 each continuing in the circumferential direction of the accommodation chamber 13 are the respective refrigerant introducing passages 319 (refrigerant introducing/discharging passages 319). The width dimension of each refrigerant introducing/discharging passage 319 is smaller than the diameter of each passage port 7 of the compressor 303. Part of each refrigerant introducing passage 319 is located inside its corresponding passage port 7.

The electric compressor 301 includes: the compressor 303 configured to compress the refrigerant; and the electric motor 305 configured to drive the compressor 301. The electric compressor 301 is provided with a doughnut-shaped (disc-shaped) refrigerant circulation passage 311 into or out of which the refrigerant having passed the passage ports 7 of the compressor 303 flows. The two long holes 319 each continuing in the circumferential direction of the accommodation chamber 13 of the electric motor 305 are provided in the partition wall 371 of a wall 315 between the accommodation chamber 13 of the electric motor 5 and the refrigerant circulation passage 311 in a manner that the refrigerant can be introduced to the stators 17 of the electric motor 305.

Figure 11:
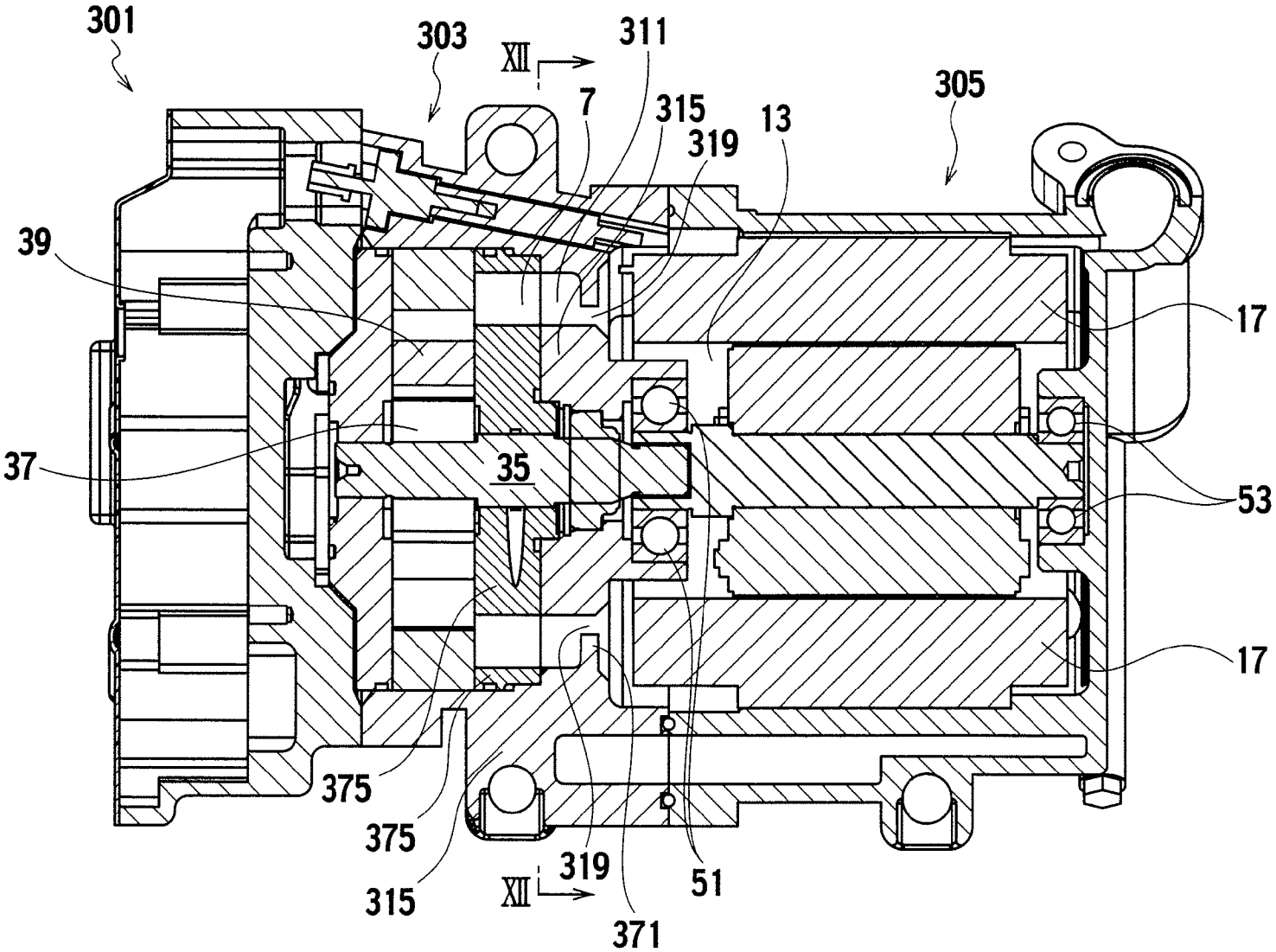
FIG. 11 is a longitudinal cross-sectional view of an electric compressor according to Embodiment 4 of the present invention.

As shown in FIGS. 12 and 13, the partition wall 371 is formed in a middle housing 373. In addition, the refrigerant circulation passage 311 is formed between a rear block 375 and the partition wall 371 of the middle housing 373 as shown in FIGS. 11 to 13. Consequently, the refrigerant circulation passage 311 causes the two passage ports 7 to communicate with the refrigerant introducing passages 319.

Figure 14:
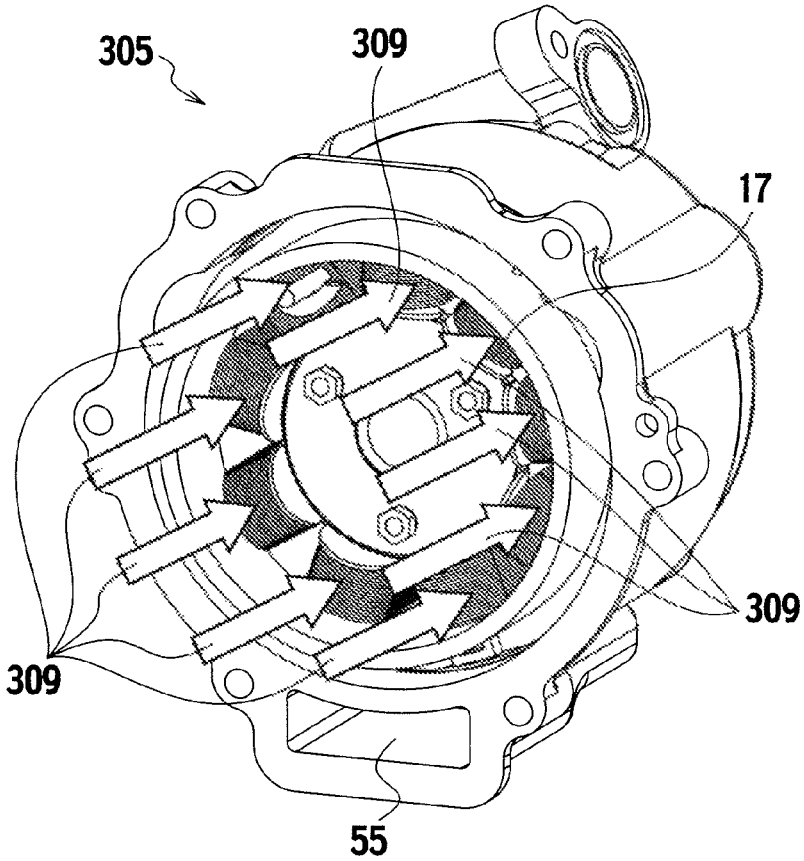
FIG. 14 is a perspective view of an electric motor constituting the electric compressor according to Embodiment 4 of the present invention.

As shown in FIGS. 12 and 13, the refrigerant having flown into the refrigerant circulation passage 311 is distributed among the refrigerant introducing passages 319 as the long holes 319. Subsequently, as shown in FIG. 14, the refrigerant thus distributed is blown from the refrigerant introducing passages 319 to the 9 stators 17 facing the refrigerant introducing passages 319, respectively, as indicated by arrows 309. Thereby, the refrigerant thus blown cools the respective 9 stators.

Incidentally, in the present embodiment, the refrigerant introducing passages 319 formed in the partition wall 371 are the continuous long holes 319. Instead, the electric compressor 301 may have a structure in which, for example, one long hole 319 is provided in a lower location whereas a round hole is provided in an upper location, as long as the refrigerant is blown to the stators 17.

Having the above-described structure, the electric compressor 301 of Embodiment 4 is capable of obtaining the same effects as Embodiments 1, 2 and 3.

Embodiment 5

Figure 15:
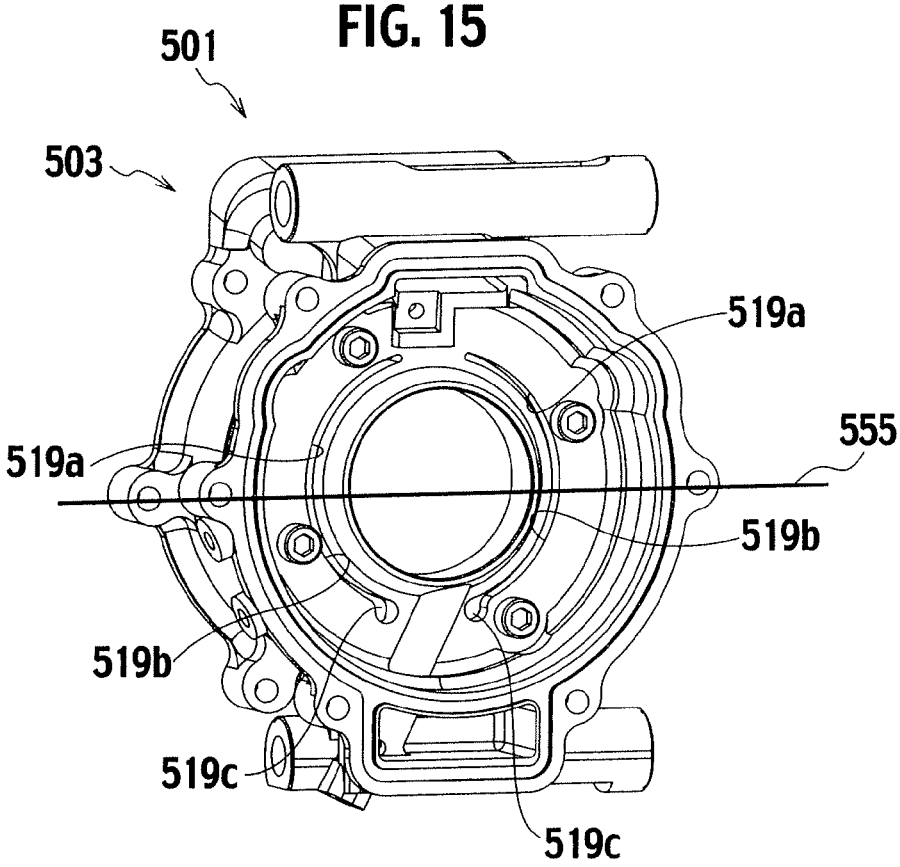
FIG. 15 is a perspective view of a compressor constituting an electric compressor according to Embodiment 5 of the present invention.
Figure 17:
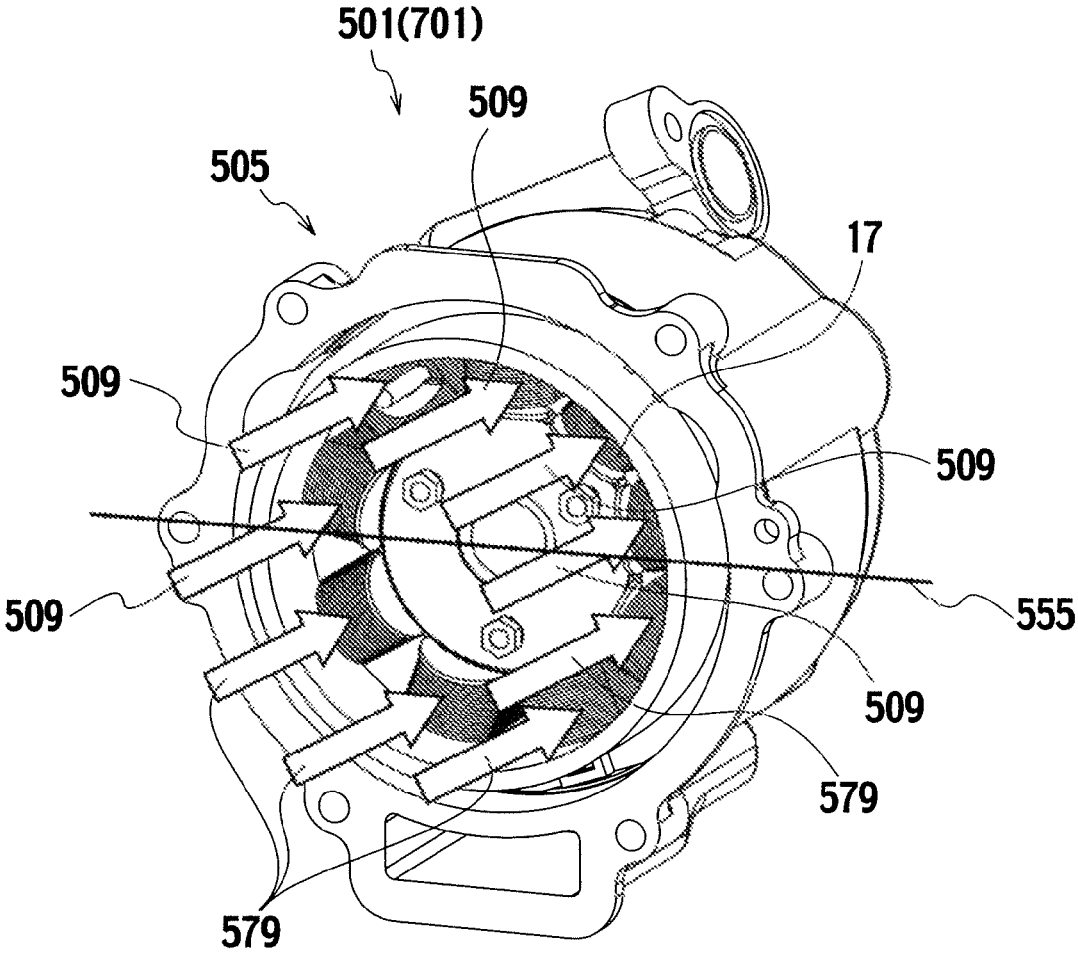
FIG. 17 is a perspective view of an electric motor constituting each of the electric compressors according to Embodiment 5 and Embodiment 6 of the present.

Descriptions will be provided for an electric compressor 501 according to Embodiment 5 by referring to FIG. 15 and FIG. 17. Note that the same components as those in Embodiments 1 to 4 will be denoted by the same reference numerals, and that duplicated descriptions for those components will be omitted.

In this embodiment, the refrigerant introducing passages 519 (refrigerant introducing/discharging passages 519) are formed of two long holes 519 each having an arc shape and provided in a way to continue from an upper location to a lower location in the circumferential direction of the accommodation chamber 13. An expanded diameter part (an expanded part) 519*c* is provided to an end portion of a lower refrigerant introducing passage 519*b* constituting a lower portion of each long hole 519. The expanded diameter part 519*c* makes the lower refrigerant introducing passage 519*b* larger in total area than an upper refrigerant introducing passage 519*a* constituting the upper portion of the long hole 519.

Consequently, a larger amount of refrigerant is blown from each lower refrigerant introducing passage 519*b* to the corresponding stators 17 provided in the respective lower locations as shown by the arrows 579 of FIG. 17, compared to the amount of refrigerant blown from each upper refrigerant introducing passage 519*a* to the corresponding stators 17 provided in the respective upper locations as shown by the arrows 509 in FIG. 17.

Having the above-described structure, the electric compressor 501 of Embodiment 5 is capable of obtaining the same effects as Embodiments 1 to 4.

Embodiment 6

Figure 16:
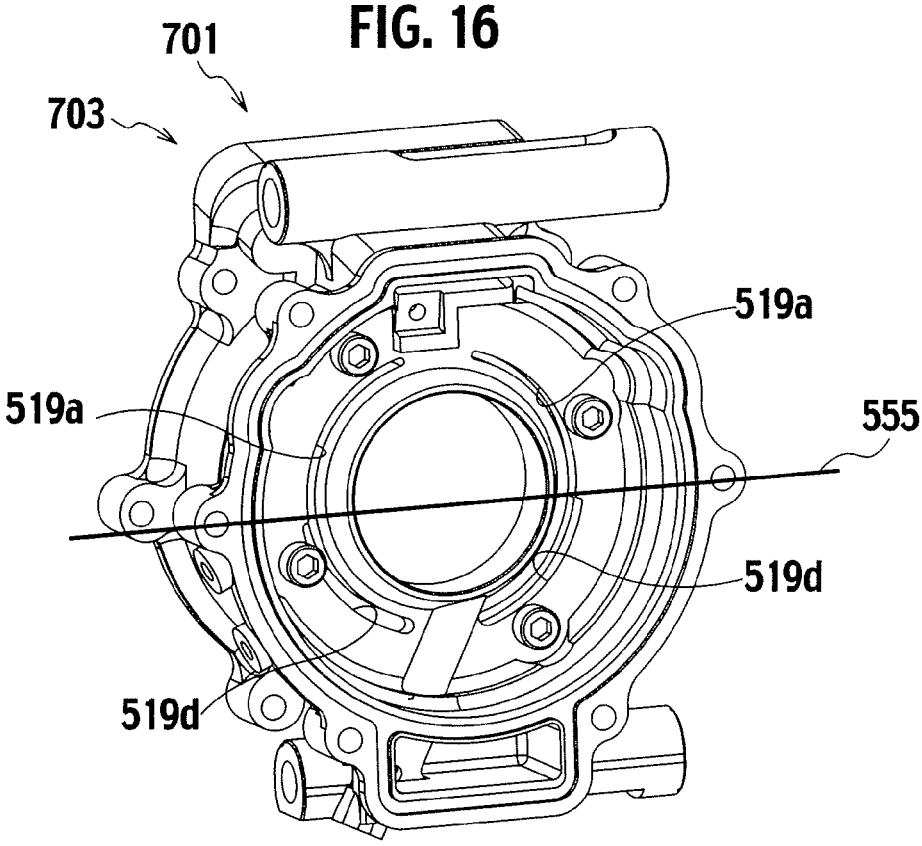
FIG. 16 is a perspective view of a compressor constituting an electric compressor according Embodiment 6 of the present invention.

Descriptions will be provided for an electric compressor 701 according to Embodiment 6 by referring to FIGS. 16 to 17. Note that the same components as those in Embodiments 1 to 5 will be denoted by the same reference numerals, and that duplicated descriptions for those components will be omitted.

In this embodiment, the refrigerant introducing/discharging passages 519 are formed of long holes 519 each having an arc shape and provided in a way to continue from an upper location to a lower location in the circumferential direction of the accommodation chamber 13. In each long hole 519, the width of a lower refrigerant introducing passage 519*d* as an expanded diameter part (an expanded part) constituting the lower portion of the long hole 519 is set larger (wider) than the width of the upper refrigerant introducing passage 519*a* so that the total area of the lower refrigerant introducing passage 519*d* can be larger than that of the upper refrigerant introducing passage 519*a*.

Consequently, a larger amount of refrigerant is blown from each lower refrigerant introducing passage 519*d* to the corresponding stators 17 provided in the respective lower locations as shown by the arrows 579 of FIG. 17, compared to the amount of refrigerant blown from each upper refrigerant introducing passage 519*a* to the corresponding stators 17 provided in the respective upper locations as shown by the arrows 509 in FIG. 17.

Having the above-described structure, the electric compressor 701 of Embodiment 6 is capable of obtaining the same effects as Embodiments 1 to 5.

The entire contents of Japanese Patent Applications Nos. P2007-332641 (filed on Dec. 25, 2007), P2008-007264 (filed on Jan. 16, 2008), P2008-288178 (filed on Nov. 10, 2008) and P2008-288181 (filed on Nov. 10, 2008) are incorporated herein by reference.

Although the invention has been described above by reference to certain embodiments of the invention, the invention is not limited to the embodiments described above. Modifications and variations of the embodiments described above will occur to those skilled in the art, in light of the above teachings. The scope of the invention is defined with reference to the following claims.

What is claimed is:

1. A horizontal type electric compressor comprising:

a compressor configured to compress a refrigerant, the compressor having a plurality of passage ports delivering the refrigerant;

an electric motor configured to drive the compressor, the electric motor having a plurality of stators and an accommodation chamber accommodating the plurality of stators, each of the stators comprising a coil wound around a ferromagnetic core;

a partition wall formed in a housing of the electric compressor, the partition wall separating the compressor and the accommodation chamber of the electric motor;

a plurality of refrigerant introducing/discharging passages formed at the partition wall, wherein the refrigerant introducing/discharging passages are located in a circumferential direction of the accommodation chamber, thereby the refrigerant being introduced into and discharged from stators end in the electric motor through the refrigerant introducing/discharging passages; and a refrigerant circulation passage formed between the passage ports and the partition wall, thereby introducing the refrigerant from the passage ports to the refrigerant circulation passage or introducing the refrigerant from the refrigerant circulation passage to the passage ports, wherein each of the refrigerant introducing/discharging passages comprises a plurality of round holes, wherein a number of the plurality of round holes is greater than a number of passage ports, and wherein a number of refrigerant introducing/discharging passages equals a number of the stators.

2. The horizontal type electric compressor according to claim 1, wherein two of the refrigerant introducing/discharging passages are horizontally located at each left and right sides of the partition wall at the portions correspond to the location of the passage ports, thereby connecting the passage ports with the refrigerant introducing/discharging passages.

3. The horizontal type electric compressor according to claim 1, wherein the refrigerant introducing/discharging passages are arranged to face the respective stators.

4. The horizontal type electric compressor according to claim 1, wherein each of the refrigerant introducing/discharging passages is made of a long hole continuing in the circumferential direction.

5. The horizontal type electric compressor according to claim 4, wherein the refrigerant introducing/discharging passages are respectively made of two long holes bow-shaped along the circumferential direction.

6. The horizontal type electric compressor according to claim 4, wherein:

a width of each of the refrigerant introducing/discharging passages is smaller than a diameter of each passage port in the compressor; and a part of each of the refrigerant introducing/discharging passages is located inside its corresponding passage port.

7. The horizontal type electric compressor according to claim 1, wherein:

the refrigerant introducing/discharging passages include:

lower refrigerant introducing/discharging passages provided in locations below a horizontal cross-section of the widest portion of the electric motor; and upper refrigerant introducing/discharging passages provided in locations above the cross-section; and a total of vertical cross-sectional areas of the lower refrigerant introducing/discharging passages is set larger than a total of vertical cross-sectional areas of the upper refrigerant introducing/discharging passages.

8. The horizontal type electric compressor according to claim 7, wherein a diameter of the round hole of the lower refrigerant introducing/discharging passages is larger than a diameter of the round hole of the upper refrigerant introducing/discharging passages.

9. The horizontal type electric compressor according to claim 7, wherein:

the refrigerant introducing/discharging passages are respectively made of two long holes each having an arc shape and provided in a way to continue from an upper location to a lower location in the circumferential direction of the accommodation chamber of the electric motor; and an expanded diameter part is provided to a lower end portion of each of the long holes of the refrigerant introducing/discharging passages so that the expanded diameter part causes a total vertical cross-sectional area of the lower refrigerant introducing/discharging passages is larger than a total vertical cross-sectional areas of the upper refrigerant introducing/discharging passages.

* * * * *